United States Patent [19]

Dobring et al.

[11] Patent Number: 4,651,609

[45] Date of Patent: Mar. 24, 1987

[54] DEVICE FOR SELECTIVELY NOTCHING OR SEVERING A PAPER STRIP

[75] Inventors: Wilfried Dobring; Wolfgang Rubey; Wolfgang Malke, all of Berlin, Fed. Rep. of Germany

[73] Assignee: Nixdorf Computer AG, Fed. Rep. of Germany

[21] Appl. No.: 808,511

[22] Filed: Dec. 13, 1985

[30] Foreign Application Priority Data

Dec. 14, 1984 [DE] Fed. Rep. of Germany ..... 3445744

[51] Int. Cl.[4] ..... B26D 5/02

[52] U.S. Cl. ..... 83/620; 83/628; 83/917

[58] Field of Search ..... 83/530, 602, 628, 917, 83/613, 615, 627, 51; 74/53–55, 57; 100/291

[56] References Cited

U.S. PATENT DOCUMENTS

| | | | |
|---|---|---|---|
| 26,147 | 11/1859 | Williams | 100/291 X |
| 1,217,521 | 2/1917 | Snyder | 83/628 X |
| 4,230,010 | 10/1980 | Guenther | 83/602 X |
| 4,416,176 | 11/1983 | Forthmann | 83/628 X |

*Primary Examiner*—James M. Meister
*Assistant Examiner*—John L. Knoble
*Attorney, Agent, or Firm*—Krass & Young

[57] ABSTRACT

The invention relates to a device for selectively notching or severing a paper strip (18), e.g. a cashier's bill, in a printer. The cutter (2) is pushed to and fro by means of a sliding block (38) arranged on it by way of a pivot, which block engages in a slide track (28). The sliding block (38) can assume two different angular positions in the slide track (28), in which the pivot (36) connecting the slide block (38) with the cutter (2) is located either radially inside or outside of the center line of the slide track (28), so that the cutter (2) reaches different end positions, in one of which the paper strip (18) is notched and in the other of which it is severed. The setting of the different angular positions of the sliding block (38) takes placed automatically through a choice of the rotation direction of the crank disk (26) showing the slide track (28). The cutter (2) shows a cutting edge (6) with two cutting edge segments (8,10) running forward and outward from the center of the cutting edge in the cutting direction (12).

10 Claims, 21 Drawing Figures

DEVICE FOR SELECTIVELY NOTCHING OR SEVERING A PAPER STRIP

FIELD OF THE INVENTION

The invention relates to a device typically used in or in connection with a printer, for cutting continuous rolled paper in either a notching or a complete-cut mode.

BACKGROUND OF THE INVENTION

In numerous printers the printed text is printed on a paper strip unrolled from a delivery roll, where the printed segment of the paper strip is automatically severed or notched after the printing in such a way that only a narrow tear-off web remains as a connection between the printed segment and the remaining part of the upper strip.

There are already printers in use with a device of the type of the species in which the cutter is moved by a moving drive against the force of a spring into a starting position and is locked there; for the cutting process the locking is released so that the cutter is moved by the spring in the cutting direction. After the paper strip is severed, the cutter strikes against a stop which delimits the path of the cutter in the cutting direction. In order to manage that the paper strip is merely notched, a further stop is provided which can be swung by an adjusting device into the path of the cutter and which limits the path of the cutter in the cutting direction in such a way that the desired tear-off web remains intact. The known device is very complicated technically, since a moving drive for moving the cutter into its starting position, a locking device operable by a control drive and also a control device for moving the second stop between its active position and its inactive position must be provided. Besides this, driving springs always represent critical component parts the failure rate of which is relatively high. A further disadvantage is also seen in that the noise generated by the cutter in striking against the stops is relatively great.

SUMMARY OF THE INVENTION

It is the problem of the present invention to create a device of the tape of the species which is simple in construction and reliable in operation and exhibits a low noise output.

This task is solved according to the invention by means of a cutter drive unit including a crank disk and an approximately circular slide track, the cutter being joined to the track by means of a slide block.

The slide track is designed as a closed, approximately circular track and is situated eccentrically to the axis of rotation of the crank disk, so that the sliding block and the cutter joined to it execute their full motion in the cutting direction and back to the starting position with each full rotation of the crank disk, starting from the starting position. The sliding block can assume two positions differing in that in a first position the connecting axis between the sliding block and the cutter falls radially further outside of the center line of the slide track than in the other position of the sliding block; in this way it is managed that with the same total stroke the stroke range is shifted more or less in the cutting direction, depending on which position the sliding block assumes. In this way in turn the cutter can be selectively moved into two different end positions one of which results in the notching and the other in the severing of the paper strip.

The sliding block has an essentially oval horizontal projection shape with a width corresponding to the width of the slide track and a length greater than this, so that the sliding block cannot be reset from one control position once this is preselected into the other control position within the slide track. In order to make possible such a resetting, the slide track in its region corresponding to the starting position of the cutter shows an enlargement corresponding at least to the length of the sliding block. In this region the sliding block can be reset from its first control position into its second control position, as will be described more precisely below. This resetting takes place automatically through the selection of the direction of rotation of the crank disk by means of a system of control surfaces arranged on the crank disk and the sliding block, as will likewise be described in more detail.

The solution according to the invention is very simple mechanically, since it manages with a single drive, for example a driving motor operable in two rotation direections, and since critical structural parts such as springs for example are not used. Besides this the device according to the invention is very easy to operate since stops against which the cutter strikes with an impact are not used at all.

The drive used for the crank disk is preferably an electric motor operable in both rotation directions which is connected with the crank disk by way of a belt drive; the control of this electric motor may be extremely simple. It need only make it possible to choose the direction of rotation as well as the stopping of the electric motor in the angular position of the crank disk corresponding to the starting position of the cutter. Starting from this angular position, it is solely the chosen rotation direction of the electric motor which decides whether the paper strip is severed or notched.

In one embodiment of the invention it is provided that the crank disk consists of a transparent material. In this way the operation of the device according to the invention, especially the position of the slide block in the slide track, can be inspected at any time, especially when there is a breakdown in operation.

In a further development of the invention it is provided that the cutter shows a cutting edge consisting of two cutting edge segments, where the two cutting edge segments respectively run obliquely forward and outward from the center of the cutting edge in the direction of the cutting motion. In this design of the cutter the paper strip is cut from the outside inward by each of the two outer edges, so that the result is a symmetrical cutting force load for the cutter and for the guide means serving for its guiding. Another substantial advantage is that the tear-off web remains intact in the center of the paper strip, so that it is possible to tear it off equally well in both directions.

In a further development of the invention, the cutting edge in the cutting edge center shows a recess with a width corresponding to the desired width of the tear-off web. In this way the width of the tear-off web is always the same even with possible slight differences in the stroke.

An embodiment example of the invention is represented in the drawings and described in detail in the following.

DETAILED DESCRIPTION OF THE PREFERRED EMBODIMENT

Figure 1:
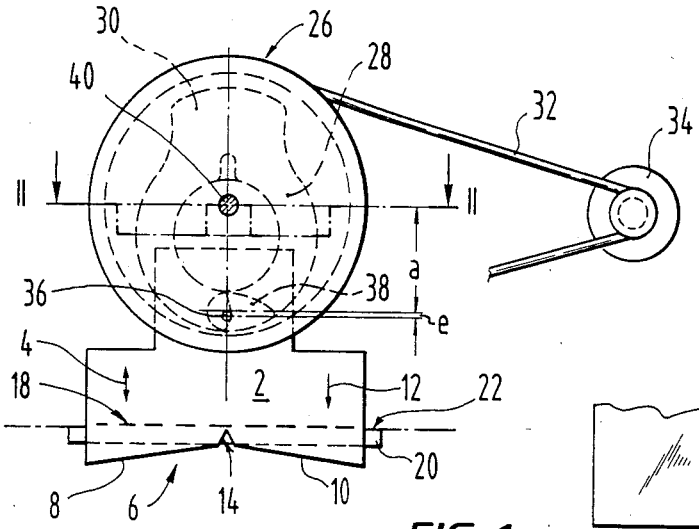
FIG. 1 shows a diagrammatic top plan view of the device for notching and severing a paper strip serving as a cashier's bill in the severing operation.
Figure 4:
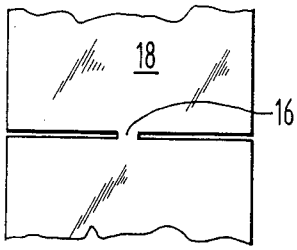
FIG. 4 shows a notched paper strip.

The cutter 2 represented in FIG. 1 has approximately the shape of an upside-down T. It is supported movable in the direction of the double arrow 4, in a manner not represented, in a printer case. The cutting edge 6 of the cutter 2 shows two cutting edges 8,10 each of which run obliquely forward and outward from the center of the cutting edge in the direction of the cutting motion 12. The cutting edge 6 also shows a recess 14 in the center of the cutting edge which recess has an opening width corresponding approximately to the desired width of the tear-off web 16 which remains intact during the notching of a paper strip 18 (see FIG. 4). During the cutting process the cutting edge 6 moves across a crossbar 20 on which is made a countercutting edge 22 interacting with the cutting edge 6.

Figure 2:
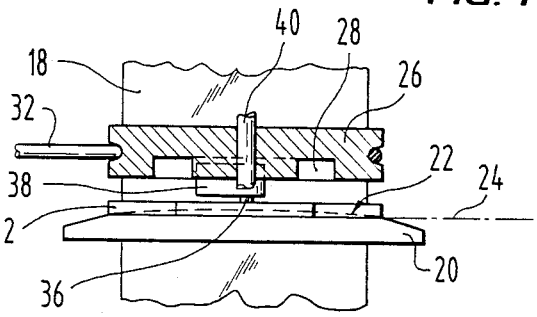
FIG. 2 shows a section along line 2—2 of FIG. 1.

As is seen particularly from FIG. 2, the top side of the crossbar 20 and thus the counter-cutting edge 22 has a convex curvature, so that the cutting edge segments 8,10 by the scissors principles always rest against the cutting edge 22 with a certain contact pressure. The convex curvature of the counter-cutting edge is shown highly exaggerated in FIG. 2 for reasons of more distinct representation.

The cutting edge plan 24 is defined by the underside of the cutter 2. Here one can overlook the fact that the cutter and/or the crossbar 20 by reason of the convex curvature of the counter-cutting edge 22 carry out a slight mutual evading motion during the cutting process so that the cutting plane 24 is not absolutely defined. The paper strip 18 is laid against the counter-cutting edge 22 perpendicularly to the cutting plane 24 and is notched or severed by the cutter 2 in the cutting plane 24, as will be further explained later.

What is used for driving the cutter 2 in the direction of the double arrow 4 is a crack disk 26 which is arranged above the cutting plane. It is provided on its underside with a substantially circular slide track 28 which shows an enlargement 30 extending outward in a radial direction. The crank disk 26 has a driving connection with an electric motor 34 by way of a driving belt 32.

A sliding block 38 which is rotatable around a pivot 36 and is fastened on the top side of the cutter 2 engages in the slide track 28. The sliding block 38 is made in approximately the shape of a drop, where its greatest width corresponds to the width of the slilde track 28, bu its greatest length is larger than the latter. The head region of the sliding block 38 has an approximately semicircular horizontal projection, while the adjacent rear part shows an outline which largely conforms in shape to the outer side surface of the slide track 28. Due to the chosen horizontal projection shaped of the sliding block 38 the latter always maintains a tangential position, prescribed by its motion in the slide track, with respect to the slide track, as long as it is not located in the enlarged part of the slide track 28.

The slide track 28 is arranged eccentrically to the pivot 40 of the crank disk 26 so that the sliding block 38 and the cutter 2 joined to it execute a motion in the direction of the double arrow 4 for one rotation of the crank disk 26. In FIG. 1, the cutter 2 occupies its outermost end position in the direction of the cutting motion 12, in which the whole cutting edge 6 has passed the counter-cutting edge 22 and has severed the paper strip 18.

As can also be seen from FIG. 1, the pivot 36 of the sliding block 38 is arranged shifted laterally on the sliding block 38 in the width direction by the amount e from the center. The distance from the pivot 36 to the axis of rotation is therefore a $+e$ when the distance from the pivot 40 to the center line of the slide track 28 equals a. This holds true for the case represented in FIG. 1 in which the sliding block 38 points to the left with its head region.

Figure 3:
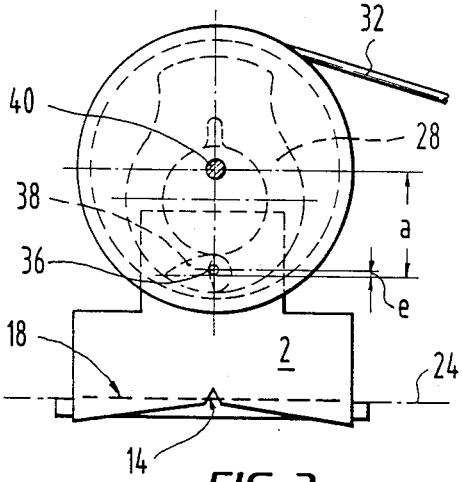
FIG. 3 shows a top plan view according to FIG. 1 in the notching operation.

In FIG. 3 the sliding block 38 assumes a position in which its head region points to the right. In this position the pivot 36 is placed radially inside the center line of the slide track 28, so that the distance from the pivot 36 to the pivot 40 is $a+e$. Therefore it is smaller by the amount of $2e$ than in the case represented in FIG. 1. As a result of this the cutter 2 reaches the end position represented in FIG. 3, in which the recess 14 in the center of the cutting edge has not yet passed the counter-cutting edge 24, so that the paper strip 18 has not been cut through in its central region. This region which is not cut through serves as the tear-off web 16 (see FIG. 4).

Figure 5:
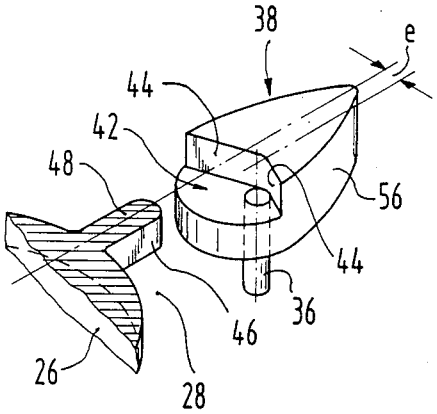
FIG. 5 shows a detail of the device according to FIGS. 1 to 3.

FIG. 5 is an enlarged perspective representation shows the sliding block 38 with the pivot 36 by way of which it is rotatably joined with the cutter 2. It is also seen here that the pivot 36 is shifted laterally by the amount e with respect to the center line of the sliding block 38. In the head region of the sliding block 38 is provided a recess 42 the lateral boundary surfaces of which serve as control surfaces 44; they interact with control surfaces 46 formed on a control finger 48 arranged on the inner lateral surface of the slide track 28. The crank disk 26 and the sliding block 38, for sake of better visibility, were represented in FIG. 5 in an opposite position in which the control surfaces 44 and 46 are disengaged.

The mode of operation of the device is represented in FIGS. 6 and 7 in various phases a to h. For this only the reference symbols necessary for the respective explanation are entered. In FIG. 6*a* the sliding block 38 is in its starting position in which its distance from the axis of rotation of the crank disk 26 is smallest. This position of the sliding block 38 corresponds to the starting position of the cutter 2, in which the latter is disengaged from the paper strip, so that it can be conveyed further without hindrance during the printing process. Upon a rotation of the crank disk 26 in the direction of the arrow 50, the control finger 48 comes in contact with the control surfaces 44 formed on the sliding block 38. The sliding block 38 is positioned in an angular position in which by its head region it moves on into the slide track 28 (FIG. 6*b*, 6*c*). The rotation of the sliding block 38 around its axis 36 is made possible by the fact that the slide track 28 possesses an enlargement 30 in its region corresponding to the starting position of the cutter 2 which enlargement must at least correspond to the length of the sliding block 38, so that the length of the sliding block 38, so that the latter can be positioned in each angular position. As FIG. 6*d* in particular shows, in this position of the sliding block 38 the pivot 36 of the latter is located radially outside the center line 52 of the slide track 28. With a further rotation of the crank disk 26 the sliding block 38 reaches its end position (FIG. 6*e*) in which its spacing apart from the axis of rotation 40 of the crank disk 26 is a+e; as has already been explained on the basis of FIG. 1, this position corresponds to the end position of the cutter 2 in the severing process. With a further rotation of the crank disk 26 the sliding block 38 leaves the slide track 28 (FIGS. 6*f*, 6*g*). When the sliding block 38 has completely left the slide track 28 (FIG. 6*h*), the control finger 48 in turn comes to lie against the control surfaces 44 of the sliding block 38 and rotates this further into a position which makes possible its entry into the slide track 28 with a constant rotation direction of the crank disk 26, as shown in FIGS. 6*a* and 6*b*.

Figure 7A:
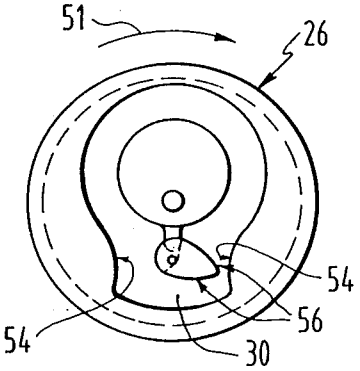
FIG. 7 shows a motion sequence of the device according to FIGS. 1 to 3 in the notching operation.
Figure 7B:
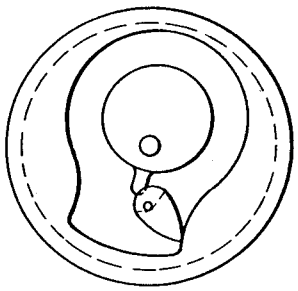
Figure 7C:
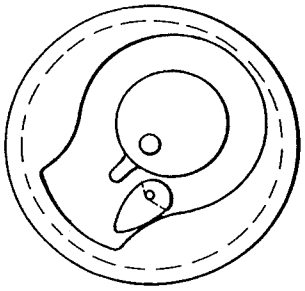
Figure 7D:
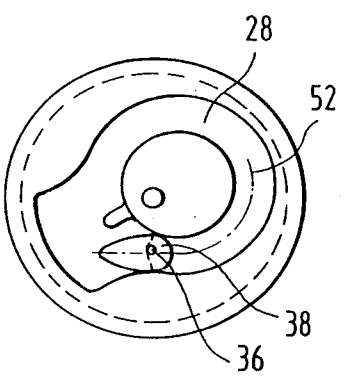
Figure 7E:
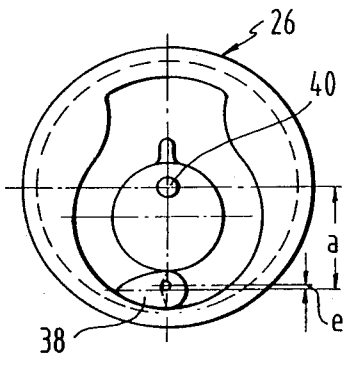
Figure 7F:
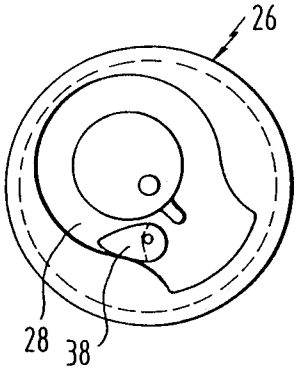
Figure 7G:
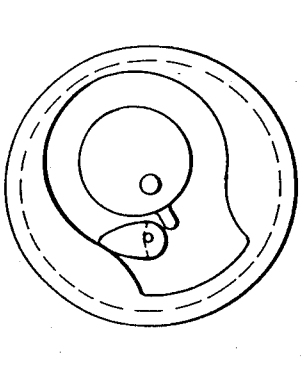
Figure 7H:
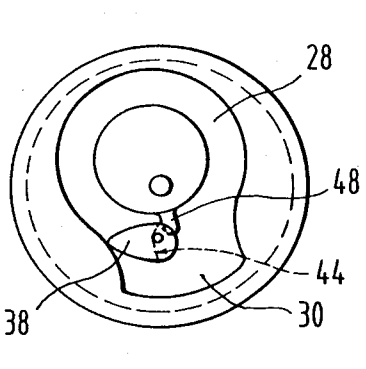

When the direction of rotation of the crank disk is reversed (arrow 51), the lateral surfaces of the enlargement 30 which are made as control surfaces 54 come in contact with the lateral peripheral surfaces, likewise serving as control surfaces 56, of the sliding block 38, so that the latter is rotated into an angular position which makes possible the entry of the sliding block 38 into the slide track 28 with the head region in front (FIGS. 7*a*, 7*b* and 7*c*). As FIG. 7*d* shows, in this angular position of the sliding block 38 its pivot 36 is located radially inside the center line 52 of the slide track 28. With a further rotation of the crank disk 26 the sliding block 38 is pushed into its end position, in which its distance from the axis of rotation 40 is a–e (FIG. 7*e*). This end position corresponds to the end position of the cutter 2 in the notching operation, as has already been explained on the basis of FIG. 3. With a further rotation of the crank disk 26 in the direction of the arrow 51 of the sliding block 38 leaves the slide track 28 (FIGS. 7*f*, 7*g*). When the sliding block 38 has completely left the slide track 28 and accordingly is located in the region of the enlargement 30, the control finger 48 comes to lie against the control surfaces 44 of the sliding block 38 and in turn rotates the latter into an angular position which permits it to enter the slide track 28, for a constant rotation direction of the crank disk 26.

Figure 6A:
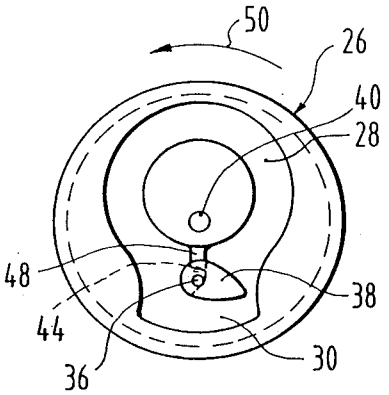
FIG. 6 shows a motion sequence of the device according to FIGS. 1 to 3 in the severing operation.
Figure 6B:
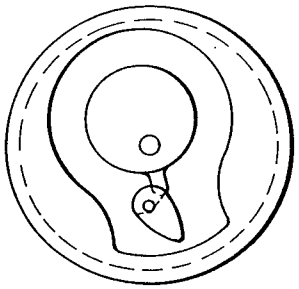
Figure 6C:
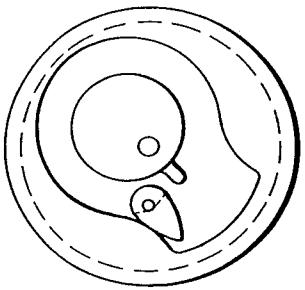
Figure 6D:
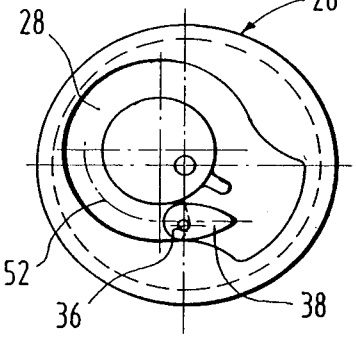
Figure 6E:
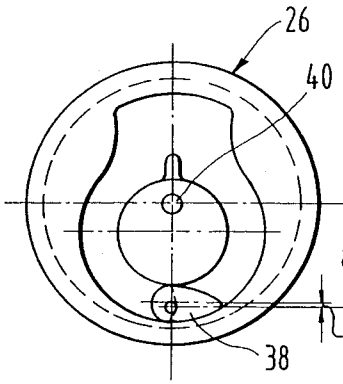
Figure 6F:
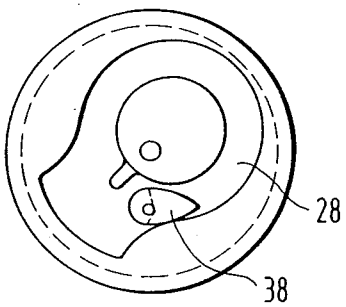
Figure 6G:
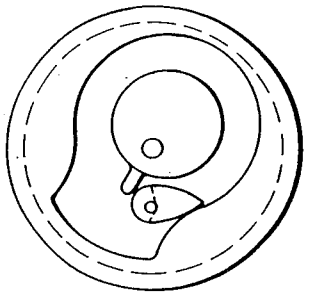
Figure 6H:
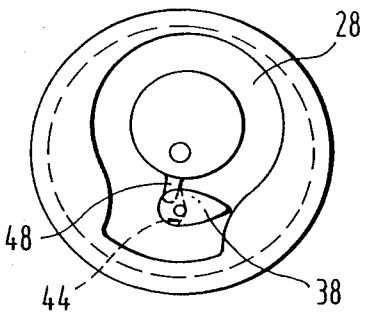

With a change in rotation direction into the direction of the arrow 50, the sliding block 38 by means of its control surfaces 54,56, in a manner explained on the basis of FIG. 6*a*, is pivoted into an angular position which makes it possible for it to enter the slide track 28 in turn with its head region forward.

We claim:

1. Device for selectively notching or severing a paper strip, with a cutter moved in a cutting plane approximately perpendicular to the plane of the paper strip with a cutting edge oblique to the direction of motion, a counter-cutting edge interacting with the cutting edge, and with a drive unit for selectively moving the cutter between a retracted starting position and a first end position in which the paper strip is completely separated or a second end position in which the paper strip is separated up to a tear-off web, characterized in that the drive unit includes a crank disk (26) arranged rotatably in a plane parallel to the cutting plane (24) and drivable in both rotation directions with a slide track (28) which is approximately circular, closed and eccentric to the axis of rotation of the crank disk (26), in that on the cutter (2) is arranged a sliding block (38) engaging in the slide track (28), having a substantially oval shape, and rotatable around a pivot (36) perpendicular to the cutting edge plane (24) the maximum width of which block corresponds approximately to the width of the slide track (28) and the maximum length of which is larger than this, where the pivot (36), laterally displaced from the center in the width direction, acts on the sliding block (38), in that the slide track (28) in its region corresponding to the starting position of the cutter (2) exhibits a broadening (30) corresponding at least to the length of the sliding block (38), and in that interacting control surfaces (46,54; 44,56) are formed respectively on the crank disk (26) and on the sliding block (38), which surfaces position the sliding block (38) in a first position when it passes through the enlargement (30) in a first rotation direction of the crank disk, a position in which the pivot (36) falls radially outside of the center line of the slide track (28), and in the second rotation direction position it in a second position in which the pivot (36) falls radially inside the center line of the slide track (28).

2. Device as claimed in claim 1, characterized in that the sliding block (38) is made approximately drop-shaped, the pivot (36) being arranged in the head region of the drop.

3. Device as claimed in claim 1, characterized in that a control finger (48) is arranged on the inner side surface of the slide track (28) in the region of its enlargement (30) which finger interacts with control surfaces (44) which are formed on the sliding block and project perpendicularly to the cutting edge plane (24).

4. Device as claimed in claim 2 characterized in that the lateral surfaces surrounding the enlargement (30) are formed as control surfaces (54) which interact with lateral surfaces turned away from the head region of the sliding block which are formed as control surfaces (56).

5. Device as claimed in claim 1 characterized in that the crank disk (26) is connected by way of a drive belt (32) with an electric motor running in both rotation directions, and in that control means are provided for stopping the electric motor at a position of the crank disk (26) corresponding to the starting position of the cutter as well as for selectively driving the electric motor in motion to the left or right.

6. Device as claimed in claim 1 characterized in that the crank disk (26) is arranged above the cutter (2) which is moved in a horizontal cutting plane (24) and in that the slide track (28) is formed on the under side of the crank disk (26).

7. Unit as claimed in claim 1 characterized in that the crank disk (26) consists of a transparent material.

8. Device as claimed in claim 1 characterized in that the cutter (2) shows a cutting edge (6) consisting of two cutting edge segments (8,10) where the two cutting edge segments (8,10) each run obliquely forward and outward from the center of the cutting edge in the direction of the cutting motion (12).

9. Device as claimed in claim 8, characterized in that the cutting edge (6) shows a recess (14) in the cutting edge center having an opening width corresponding approximately to the desired width of the tear-off web (16) which is to remain intact in the cutting.

10. Device as claimed in claim 1 characterized in that the counter-cutting edge (22) is arranged in a plane transverse to the cutting direction (12) and is curved in a convex shape.

* * * * *